US006863600B2

(12) United States Patent
Friel, Sr.

(10) Patent No.: US 6,863,600 B2
(45) Date of Patent: Mar. 8, 2005

(54) APPARATUS FOR PRECISION EDGE REFINEMENT OF METALLIC CUTTING BLADES

(75) Inventor: Daniel D. Friel, Sr., Greenville, DE (US)

(73) Assignee: Edgecraft Corporation, Avondale, PA (US)

( * ) Notice: Subject to any disclaimer, the term of this patent is extended or adjusted under 35 U.S.C. 154(b) by 69 days.

(21) Appl. No.: 10/321,019

(22) Filed: Dec. 17, 2002

(65) Prior Publication Data

US 2004/0116055 A1 Jun. 17, 2004

(51) Int. Cl.[7] ..... B24B 7/00

(52) U.S. Cl. ..... 451/293; 451/54; 451/234; 451/259; 451/282

(58) Field of Search ..... 451/54, 55, 67, 451/68, 192, 193, 196, 198, 202–208, 224, 229, 234, 293, 259, 282, 177; 76/89, 89.2; 72/71, 211

(56) References Cited

U.S. PATENT DOCUMENTS

| | | | | | |
|---|---|---|---|---|---|
| 2,692,457 | A | * | 10/1954 | Bindszus | 451/65 |
| 4,285,253 | A | * | 8/1981 | Edling | 76/84 |
| 5,611,726 | A | * | 3/1997 | Friel et al. | 451/177 |
| 5,704,829 | A | * | 1/1998 | Long | 451/558 |
| 5,761,947 | A | * | 6/1998 | Barnes | 72/203 |
| 6,012,971 | A | * | 1/2000 | Friel et al. | 451/45 |
| 6,113,476 | A | * | 9/2000 | Friel et al. | 451/177 |

* cited by examiner

*Primary Examiner*—David B. Thomas

(57) ABSTRACT

A finishing apparatus modifies the physical structure along the edge of a metal knife blade wherein the edge is formed at the junction of two edge facets presharpened with abrasives. The finishing apparatus consists of at least one precision angular knife guide that positions the edge of the blade into contact with the rigid surface of a driven moving member and positions the plane of the adjacent edge facet at a precise predetermined angle relative to the plane of the rigid surface that is harder than the metal of the knife and is without tendency to abrade.

35 Claims, 3 Drawing Sheets

APPARATUS FOR PRECISION EDGE REFINEMENT OF METALLIC CUTTING BLADES

BACKGROUND OF THE INVENTION

This application relates to an improved method and apparatus for modifying the shape of the cutting edge of knives and blades to improve their cutting efficiency. The term "knife" or "blade" used herein interchangeably includes a vast array of cutting devices with sharp edges including for example butcher knives, kitchen knives, razors, plane blades, scalpels, chisels, scissors, shears and the like.

Knives and blades are used in a variety of applications for cutting any of a wide range of different materials including vegetables, meats, woven products, cloth, paper products, plastic products and wood products. Most knives are made of metals such as specially hardened steels, however some specialized knives are made of ceramics such as alumina. There are also diamond knives made of single crystal diamonds which because of their ultra strength and hardness can be used to cut and slice harder materials such as metals and selected inorganic crystalline materials, in addition to the softer organic materials.

The vast number of cutting tools are made of metals particularly specialized steels which include carbon to strengthen and increase the durability of the cutting edge together with alloying elements such as molybdenum, vanadium and tantalum, to increase the flexibility and the hardenability of these special steels which generally must be carefully heat treated in order to develop their ultimate strength and flexibility.

The profile of most cutting edges are V-shaped, formed by a series of machining and grinding steps that become more precise in those final steps that create the final edge.

The creation or development of an ultrasharp edge has been the subject of patents by this inventor, including U.S. Pat. Nos. 4,627,194; 4,716,689; 4,807,399; 4,897,965; and 5,005,319 which describe precision mechanical means for abrading an edge with successively finer diamond abrasives and a precision orbital motion to refine the final edge. Further the U.S. Pat. Nos. 5,611,726; 6,012,971; 6,113,476; and 6,267,652B1 by this inventor describe advanced means using a combination of rigid abrasive sharpening elements and unique flexible stropping wheels to form the final ultrasharp edges. Each of these patent references and numerous by others describe successive steps of abrading the edge with finer and finer abrasives to make the final edge as geometrically perfect as possible.

Refinement of the cutting edge by using finer abrasives while sharpening with powered sharpeners or by hand at successively larger edge facet angles will create ultrasharp metal edges, but the perfection of the edge is always limited by the formation of a burr albeit microscopically small along the cutting edge. A burr is formed by the abrasive process as it removes metal along the edge. The very fine edge being created in the final steps can be exceeding by small at its terminus—less than one thousandth of an inch and commonly on the order of a few microns. Such a terminus is exceedingly weak or fragile and it easily bends away from the abrasive as the abrasive attempts to remove more metal in order to form a still finer edge. As more metal is removed—albeit with a relatively low abrading force, that fine edge is bent out of the way in response to the sharpening action of the abrasive—hence creating a burr. Hence the cutting edge is not positioned as a geometric extension of the edge facets but rather is bent over asymmetrically—away from the last abrasive action.

Existence of the bent-over burr destroys the edge geometry and reduces the cutting effectiveness of the edge. When the edge is used for cutting, that burr tends to bend over still further under the forces of cutting and the knife dulls quickly.

The particulate nature of abrasives whether used as loose particles, adhered to a substrate, or on the surface of a bulk abrasive block—(as on an Arkansas stone) tends to create an intermittent burr along the cutting edge. Instead of being a continuously unbroken burr, it tends to be segmented along the edge, broken up into a series of micro burr-like segments along the edge that give the edge a micro serrated characteristic. The smaller the particle size of the final abrasive grit, the smaller the burr is and the smaller are the micro serrated segments.

When cutting smooth non-fibrous vegetables such as tomatoes, cucumbers, and avocados, it is important that any burrs or microserrations along the edge be as small as possible. A knife with very small burrs and microserrations gives a cleaner cut and a better presentation of such food. On the other hand when cutting fibrous foods such as meats, corn, carrots, and baby pumpkins, any microserrations along the edge may aid the cutting process by virtue of a micro-blade or micro-sawing action that they provide. Because of their minute physical dimensions and broken structure along the edge, such residual imperfections can themselves be very sharp and constitute micro blades that aid in cutting For an edge to be an effective aid in cutting fibrous materials such as meat, paper products, etc. edge imperfections must not be too large. Further edge imperfection must not be bent too far out of alignment with the edge facets or it will simply bend over quickly when cutting and be ineffective in cutting.

SUMMARY OF INVENTION

In recent years this inventor and others have introduced to the market several precision knife sharpeners that create extremely sharp and durable knife edges. In these precise sharpeners the sharpening process which uses abrasive materials to remove metal along the facet commonly creates a burr—a bent-over edge—at the terminus of the edge, albeit in some instances it is exceedingly small and detectable only under high power microscopic examination.

Until this time there has been no precision means to subsequently modify the geometry of such burrs or their orientation in a manner that enhances their ability to contribute reliably to the cutting action and the longevity of the resulting edge.

It has been shown that with the unique precision apparatus described here one is able to precisely and accurately reshape the burr geometry, following precision abrasive sharpening to create reproducibly a very sharp edge capable of shaving, creating an edge geometry that retains an extra "bite" that is particularly evident when cutting fibrous materials. This precision means used to reshape the edge insures optimum alignment of edge segments with the pre-existing axis of the edge facets thereby reducing premature failure of the edge (due to bending-over of the segments burr) when cutting with that edge.

The success of this apparatus and method depends upon the high precision and control of the relative sharpening angle of the blade in the final preceding sharpening stage, and an equally precise control of the relative angle of contact of the blade facets at the surface of a moving surface such as a unique non-abrasive rotating reshaping disk that is brought into controlled contact with the abrasively sharpened edge. The reshaping disk, or other moving member force-loaded in its rest position against the edge facet by a spring or other means, exerts a controlled force against the edge and burr segments displaced by the prior abrasive sharpening of the edge, and forces those segments into favorable shape and alignment with the edge facets. The surface velocity of the shaping disk, the force constant of the spring and the time of contact with the burr segments must be optimized for best orientation and shaping of residual segments along the edge. The rotating action of the non-abrasive reshaping disk tends to modify, and straighten or remove burr segments at the same time that those remaining segments are brought into better alignment with the cutting axis of the major edge facets.

This application describes precision non-abrasive means to modify and reshape the edge of metal knives created by prior abrasive sharpening processes. The shaping means can be powered either electrically or manually and the precision shaping member preferably a non-abrasive rotating member with a cone-shaped surface can alternatively be for example a rotateable disk, a rotating or oscillating cylinder, a reciprocating planer member, or an oscillating planer member set at a fixed angle to the angle of the knife edge facets. Precision guides must be provided for the knife or blade that control and optimize the angular relationship between the contacting surface of the shaping member and the facets of the edge. To optimize performance of the resultant edge, means can be provided to control the force applied against the fragile burr and edge structure by the shaping means: The velocity of the shaping surface also can be optimized as well as the duration of contact between that surface and the edge structure. The surface texture of the shaping disk is preferably smooth but it can be somewhat rougher in order to develop edges optimized for cutting a particular food or material.

THE DRAWINGS

DETAILED DESCRIPTION

The precision apparatus described here is designed to reshape the cutting edge of metallic knives and blades that have been sharpened first by conventional abrasive means. Abrasive means either powered or manual can create a metal edge by using abrasive materials to cut, skive, or machine metal off of adjacent metal surfaces so that they intersect along a line that constitutes the edge. The abraded surfaces adjacent to the edge, commonly referred to as facets, are formed along an extended relatively thin piece of metal. Each facet is commonly formed on one side of the metal blade at an angle of about 15 to 25 degrees from the flat surface of the blade face. The facets therefore commonly meet at the edge at a total included angle of 30 to 50 degrees, but occasionally edges of smaller or larger angles are encountered. There are also blades with a ground facet on one side of the blade that intersect the opposite face of the blade to form an edge.

While facets and edges could be formed by casting from the molten state or by removing metal with thermal or chemical processes, edges are generally created by abrasive means which necessitates abrading forces large enough to exceed the tensile strength of the metal and rupture its surface as metal is removed.

Figure 1:
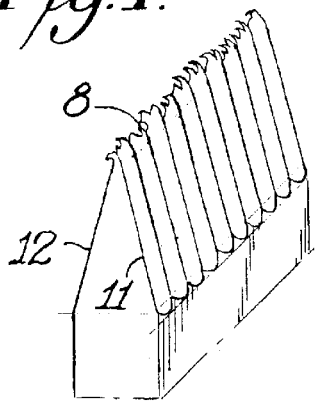
FIG. 1 is a perspective view of a blade having bent burrs.

To create exceedingly sharp edges one can reduce the size of abrasive particles in successive sharpening steps. In that manner the sharpness of the formed edge is progressively improved because irregularities in the edge profile become smaller and smaller. At the same time smaller forces can be used to abrade the edge facets. If this process is extended to finer and finer grits, ultimately the abrading forces are attempting to form an edge whose terminus "thickness" is on the order of only a few microns. Fine edges can be bent over by forces that are much smaller than the lateral forces necessary to abrade further metal from that fine edge. As a result efforts to use such abrasive means to finalize the geometry of an edge can become counterproductive. The edge bends over forming a weak unsupported burr such as shown in FIG. 1. Burrs are formed in virtually all physical metal-removing processes that extend to and meet an edge because the forces needed to remove metal (to break metallic bonds) exceed the force necessary to exceed the elastic limit which bends the metal at the edge. Burrs appear along the edge in a knife sharpening process and as might be expected their size is directly related to the size of abrasive particles, the force applied to remove metal from the facet and the metal removal rate. Simply the burr becomes smaller with each reduction in grit size or metal removal rate. However, small as it becomes, the abrading process creates a burr along the edge if that edge is geometrically formed in that manner.

Burrs formed as described above are exceedingly weak and they are easily bent over and further wrapped over the edge by forces encountered when cutting with a sharpened blade. The thickness of the burr at its terminal end may be less than one-thousandth of an inch or even only a few microns. It is easy to understand how frail such burrs are if they are visualized as a foil or a metallic sheet only one-thousandth of an inch thick or less. The burr as formed commonly has an aspect ratio (length to thickness ratio) as high as 10–20 which in view of its minimal thickness leaves a very weak edge on the blade—unfit for serious cutting. Such elongated thin burrs are sometimes referred to as wire-burrs, reflecting their extremely thin cross section and minimal strength. Such burrs can give an edge the appearance of being exceeding sharp but when that edge is subjected to a heavier cutting load it folds over quickly and creates a very dull edge.

The apparatus disclosed here provides a novel precision means of modifying the structure of the burrs along the edge and alters the structure of the edge itself in a manner that leaves edge imperfections with a much smaller aspect ratio (length/thickness) and hence creates a stronger, more effective cutting edge well suited for cutting a wide variety of fibrous materials including meats and fibrous vegetables. Cutting tests on many materials have shown the superiority in terms of sharpness and durability of edges finished by this precision means-compared to edges formed by strictly manual means or by conventional powered means.

The apparatus disclosed here positions the knife edge facets generally presharpened by abrasive means at a precisely controlled angle to the surface of a manually or motor powered member. The surface of that member is relatively smooth and made of a nominally non-abrasive material. In a preferred form the member is made of a material such as hardened steel with surface hardness greater than the blade edge and with a surface roughness (Ra) less than 10 microns. The surface roughness can be optimized in accord with the physical strength, hardness, and ductility or brittleness of the material of composition of the blade and its edge. Rarely will a roughness greater than Ra of 40 microns prove beneficial.

While apparatus according to this disclosure can take many physical forms the following describes a preferred means that has been demonstrated to produce edges of superior cutting ability and durability.

Figure 2:
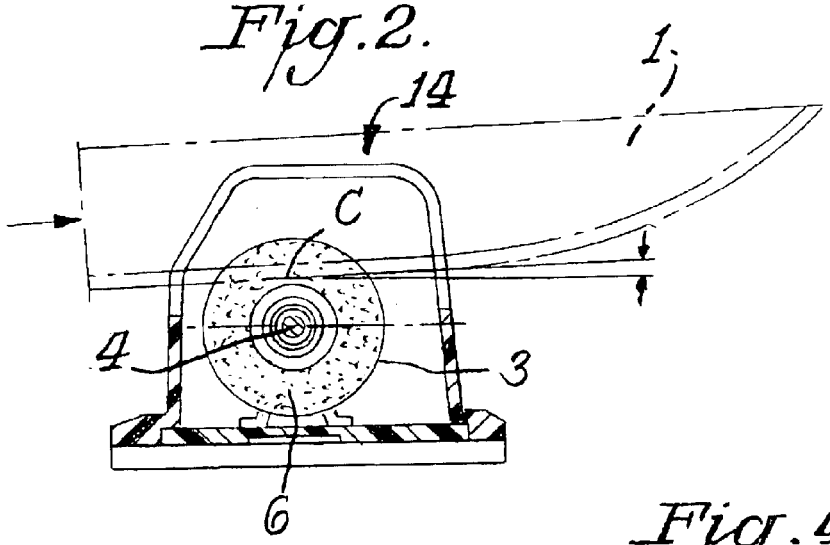
FIG. 2 is a side elevation view partly in section of an apparatus in accordance with this invention showing a blade moving through the apparatus.
Figure 3:
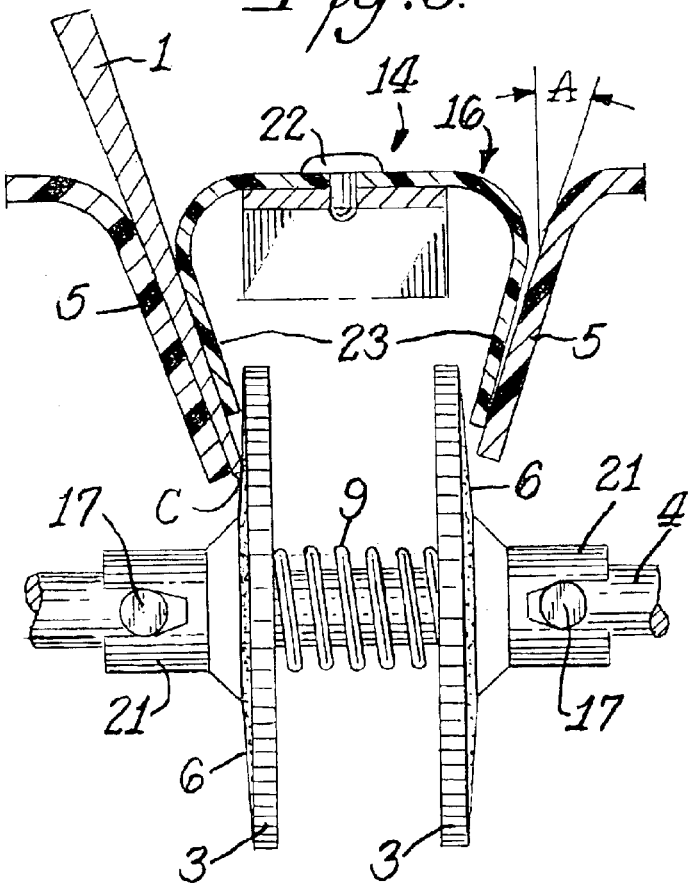
FIG. 3 is a front elevation view partly in section of the apparatus shown in FIG. 2.
Figure 4:
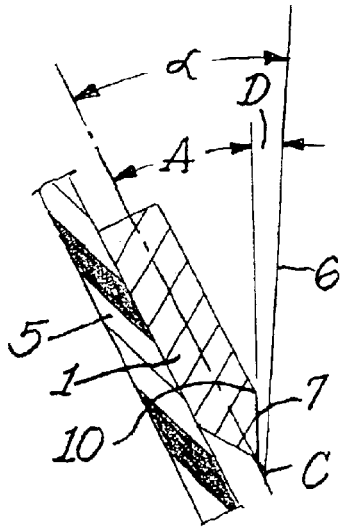
FIG. 4 is an enlarged front elevation view of a portion of the apparatus shown in FIGS. 2–3.

FIGS. 2 and 3 show a blade, 1, being moved through an edge-finishing device, 14, which contains a disk, 3, mounted on shaft, 4. The surface of disk 3 is in this example a truncated cone. The apparatus includes knife guides, 5, that position the blade, 1, at a precisely controlled angle related to the conical surface, 6 at point of edge contact. As shown in FIG. 4 the facet 7 of blade 1 is positioned at an angle A with respect to the bisecting line of the blade 1. Since the bisecting line of the blade 1 is also shown to be parallel to the guide surface of knife guide 5 the angle A is also the angle between facet 7 and the guide surface. As also shown in FIG. 4 the contact surface 6 of the disk is at an angle $\alpha$ with respect to the bisecting line of the blade 1 which is the same angle as surface 6 with the guide surface of guide 5. As also shown in FIG. 4 the surface 6 is at an angle D to the plane of the facet 7. The angle D is shown in FIG. 4 as being the difference between the angle $\alpha$ minus the angle A. As shown in the facet, 7, of blade 1 is positioned precisely at an angle D to the surface of 6 of the conical surface. For optimum performance angle D must be held to within 5° of the facet, preferably not more than ±3° from the parallel to facet 7.

In order to understand the criticalness of angle $\alpha$ for optimum results consider the shape of the burr created by an abrasive process as represented in FIG. 1. The burrs form along the edge as a broken segmented structure resulting from the irregular pattern of grooves plowed into the facet surfaces by the abrasive particles. The burr segments, 8, along the edge are bent away from the edge of that facet last abraded. In FIG. 1 the front facet 11 as shown was last abraded and consequently the burr segments, 8, are bent down and away from that facet surface. The size of the burr segments depends upon the size of the abrading particles, their velocity, and the magnitude and direction of forces applied to the abrading materials. The randomness of the location along the edge and shape of the burr segments is related to the variations in groove size and location on each of the facets at the edge. Certain of the grooves meet the edge where on the opposite facet there is little material and thickness thus forming a smaller burr segment than other grooves that intersect the edge where the effective thickness is greater. If the cutting edge is not further refined, large burrs such as portrayed in FIG. 1 along that edge will cut poorly as the burrs are caused to fold over by any cutting actions.

Figure 5:
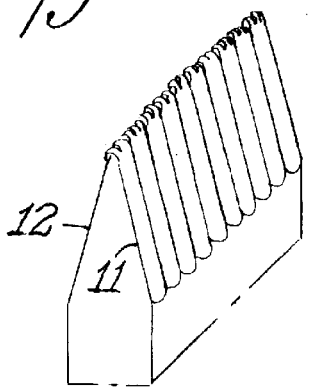
FIG. 5 is a view similar to FIG. 1 of a blade after being passed through the apparatus of FIGS. 2–4.
Figure 6:
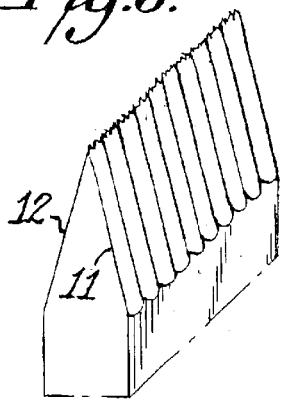
FIG. 6 is a view similar to FIG. 5 of a blade after further burr removal.
Figure 7:
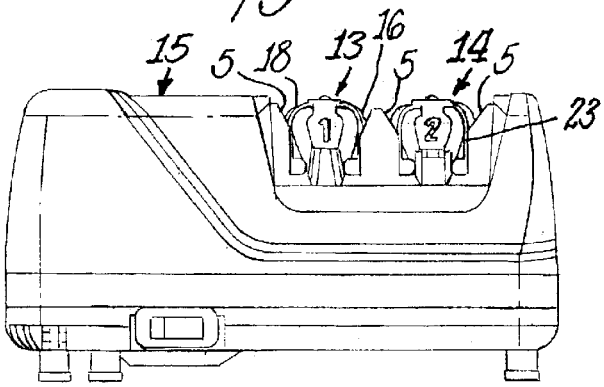
FIG. 7 is a side elevation view of an apparatus in accordance with this invention.
Figure 9:
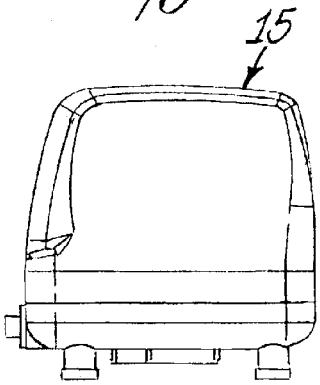
FIG. 9 is an end elevation view of the apparatus shown in FIGS. 7–8.

With the precision apparatus described here the edge of FIG. 1 can be modified without further abrasive action to create an improved cutting edge free of the large burr segments of FIG. 1. FIG. 5 and FIG. 6 illustrates how the blade edge is modified as it is passed repeatedly through this edge finishing apparatus.

If the angle $\alpha$, FIG. 4, is held preferably within 5° of angle A, the moving finishing wheels, 6, of FIG. 3 will reconfigure the burr and reconfigure the supporting structure along the edge and under the burr in a manner that improves the edge and ultimately eliminates the burr described above by a compressing and fracturing process. As this process is continued the physical nature of the cutting edge is greatly improved creating an edge capable of shaving. It is important that the angle $\alpha$ be close to angle A and consistently close during the entire finishing operation. This type of consistent angular control requires a level of precision unattainable by any manual means. Without good control the fragile edge is readily destroyed before its optimum sharpness can be obtained. The force of spring 9, FIG. 3 must be sufficiently small in order to avoid excessive lateral force against the fragile edge, and the surface roughness of the rotating or moving surface 6 also must be carefully chosen to avoid excessive fracturing of the hardened metal edge. If angle $\alpha$ is larger than angle A, FIG. 4 the moving surface 6 will contact the edge with the full force load of spring 9. If angle $\alpha$ is smaller than angle A, the moving hardened surface will contact primarily the shoulder area 10, of the blade which will reduce the direct force of the moving finishing wheel onto the edge but depending on the burr size and extent of its bend the surface 6 in this situation may selectively reshape the burr with less stress on the supporting structure of the burr. Depending on the physical properties of the metal blade at its edge and the intended use of the blade, one can optimize angle $\alpha$ accordingly.

If angle $\alpha$ is slightly larger than angle A, and the edge is finished with the disclosed apparatus first along one facet and then the other, it was found that at first the burr is either straightened with the disclosed apparatus to a more upright position bent to the opposite side of the edge or it is bent over further against the edge structure. Because the burr is so thin and if its aspect ratio (length/thickness) is large its strength may be too low when straightened to be effective in cutting without bending over again quickly and leaving a dull edge. On the other hand this inventor has found that if the disk or member is moving in a direction relative to the burr that bends or folds the burr over against the edge facet 12 as shown in FIG. 5, successive passes over the moving finishing member 6 will cause the edge structure to work harden and fatigue and the burr will break off in a manner which minutely fractures the edge supporting structure leaving an edge as shown in FIG. 6 which has a large number of very small edge imperfections along each side of the edge. The resulting edge is extremely sharp, capable of shaving yet the small imperfections give the edge a greater "bite" than edges of greater geometric edge perfection. This type edge is very desirable for cutting a variety of the more fibrous materials and foods.

If the angle $\alpha$ is slightly smaller than angle A, the moving surface 6 FIGS. 3 and 4, will be in contact with the shoulder 10 above the facet and also in contact with the burr if the burr as bent by prior sharpening extends sufficiently to contact the moving surface. In that event, the burr will be selectively partially straightened, reformed, or pushed against the nearest facet. It will nevertheless stress and work harden or fatigue the edge structure supporting the burr and on successive contacts with the moving surface the metal originally constituting the burr will break off causing the supporting structure to fracture. The degree of fracture depends on the tensile strength and brittleness of the metal of which the edge is made and its susceptibility to fatigue fracture. Generally metal knives are hardened to the range Rockwell C 50 to 60 which is generally subject to fatigue fracture.

Consequently irrespective of whether angle α is slightly larger or smaller than—but close to-angle A the edge structure will ultimately begin to fracture as the knife edge is repeatedly shaped by the moving member thus creating an edge with a series of sharp microblades along that edge. The exact sequences of bending or straightening the blade can be optimized for the desired resulting blade. For blades intended to cut hard textured bread, it may be desirable to generate larger microblades along the edge, while for cutting lemons, limes, etc. a finer series of microblades will be desirable.

For optimum results the surface velocity of the moving finishing surface can be optimized. The lateral force of the moving structure 6 against the blade edge can be controlled and optimized by carefully selecting the spring constant of spring 9, FIG. 3 or its equivalent so that excessive forces are not applied directly to the fragile edge structure. Excessive forces can cause the edge to fracture below the point of burr attachment and create a coarser edge with larger but less sharp microblades.

Consequently this means of finishing edges that have been presharpened by abrasive means is extremely versatile in creating edge structures optimized for the end application without resorting to conventional abrasive means that may create more burrs that interfere with the cutting process. Clearly as the finished edge created by this new finishing means is used, it becomes "dull". It can then be refinished by this means a number of times, but ultimately the fracturing process will leave an edge too coarse and dull to be improved further by this finishing means. At that point it is necessary to resharpen the blade by a conventional means such as abrasive sharpening. It is convenient therefore to incorporate a means for conventional abrasive sharpening in the same apparatus as this new finishing means.

FIGS. 7, 8, 9 and 10 are views of a combined knife sharpening and finishing apparatus 15, which incorporates a sharpening stage, 13, and a finishing stage 14 as described herein.

In a preferred embodiment the finishing disk 3 of FIG. 3 is made of hardened steel preferably harder than the steel in the knife to be sharpened. Its hardened surface 6 has the shape of a truncated cone. The angle of the knife 1, FIG. 2 relative to the surface 6 of disks 3 is controlled by rigid angle guides 5 located adjacent to the disks 3. When the knife blade 1 is inserted in intimate contact with the surface of rigid angle guide 5, it is inserted between the angle guide and the spring structure 16 where it is held securely at the angle A, FIG. 3 to the vertical by the spring 16. The retaining force of spring 16 is not so great as to interfere with the need to move readily the blade manually through that slot between angle guide 5 and the extended arm 23 FIG. 3 of spring member 16. The knife blade is shown again at angle A, FIG. 4 relative to the vertical as it is pulled along guide 5. Simultaneously the blade is held at angle B, FIG. 8 relative to the horizontal center line 27 of the finishing stage 14. In this manner the edge of blade 1 is brought into contact with the truncated cone surface 6 of disk 3 at point C, FIG. 2. This point of contact C is commonly at a point on a radius approximately 45° from the vertical and at a distance approximately 75% of the radius from the center of the shaft. The exact point of contact affects the angle and direction of the surface movement across the knife edge. The angle of the surface movement relative to the edge line modifies the nature of the bending that occurs to the burr. That angle is selected depending upon the optimum for a given blade and its intended use.

In a typical finishing stage the surface velocity of the finishing disk surface at point of contact with the edge is on the order of 100 to 1,500 ft./minute. The force against the knife edge required to displace the disk from its rest position against spring 9, commonly selected at or less than 0.2 lb. The higher the force required to displace the spring the greater will be the rate of edge fracture. With lower spring displacement forces it takes more pulls through the finishing stage to realize an edge capable of shaving. With a spring force of 0.1 lb. it takes about 6 pulls on each side of the edge to realize an edge able to shave hair. This edge when dulled by cutting can be reshaped many times before it is necessary to resharpen the edge by abrasive sharpening means such as 13 FIG. 7 and FIG. 8.

A precision combined knife sharpening/finishing apparatus such as shown in FIGS. 7, 8, 9, 10 is optimal for efficient use of the finishing stage. As reviewed above the finishing operation should be carried out at an angle α very close to the prior sharpening angle A (see FIG. 4). Unless then the sharpening is carried out in a precision sharpening stage where the angle of the facets is created and known with great accuracy, the finishing operation may be less than optimal and in fact may be destructive of the edge created in the sharpening stage. By incorporating these two step sharpening and finishing in a single machine both angle A and α can be set precisely and optimally relative to each other for the best finishing results.

Figure 10:
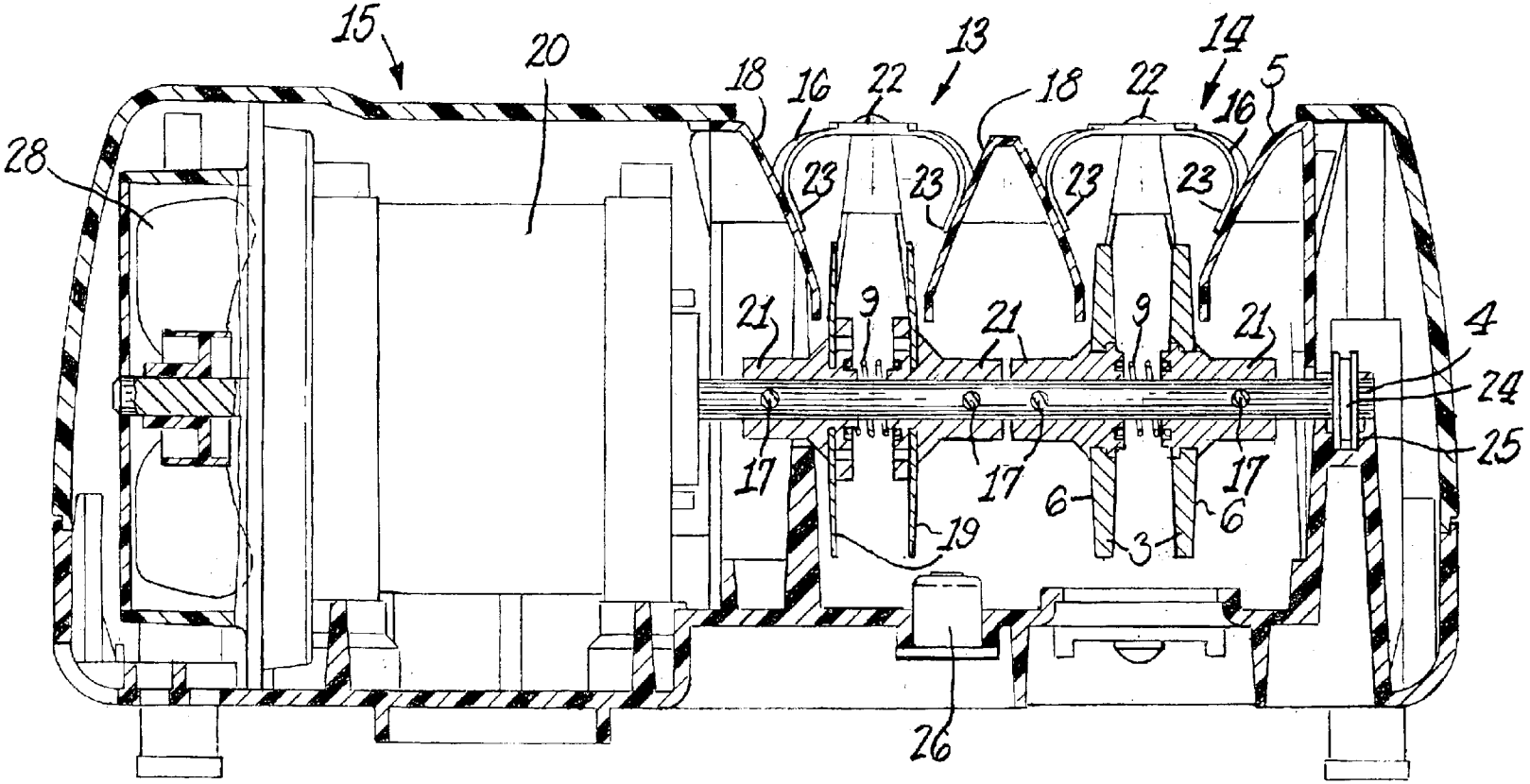
FIG. 10 is a cross sectional view taken through FIG. 8 along the line 10—10.

The precision sharpening stage 13 in the combined sharpener FIGS. 7, 8, 9, 10 is shown as an example of a precision sharpening stage where the sharpening angles and hence the angles A of the facets are precisely created at a predetermined angle. An angular accuracy of 0.5 degree is readily obtainable with this design sharpening stage. The angular guides, 18, of the first stage (sharpening) FIG. 10 are similar to the angular guides 5 of the second (finishing) stage but the guides of the first stage may for example be set at a slightly smaller angle A than the angle α of the second (finishing) stage, as explained above. The precisely shaped sharpening disks are for example rigid stamped metal disks with a truncated cone shaped surface covered with an abrasive coating of diamonds or other abrasive particles. The disks are driven by shaft 4 of motor 20. The finishing disks of the second stage are also driven by the same shaft.

Depending upon the intended use of the knife created in this two step sharpening/finishing process, the resulting edge can be optimized by selection of the particle size of the abrasive used in the sharpening step. By using a coarser grit the resulting edge imperfections are larger in magnitude while using a finer grit results in smaller imperfections. For blades intended to cut hard bread crust a grit of 60 grit may appear to give a good edge. For blades to be used to cut tomatoes and other soft vegetables a grit of about 200–270 will result in an edge of fewer imperfections and one that will cut smoothly yet retain some bite. Grit size of 1200 will give a still finer edge and yet retain some bite. As the grit becomes finer the microteeth will be finer. The supporting structure of the burrs and the remaining edge will continue to fracture with subsequent passes through the finishing stage under the restoring force of the spring or other restraining means used to press the moving member against the edge. Ultimately the cutting quality of the edge deteriorates to the degree the edge must be resharpened with the abrasive disks in Stage 1.

While presented as an example, the rotating disk described above with a truncated cone surface is a very convenient means for finishing the edge. However, with changes to the guiding mechanisms a variety of other moving surfaces can be used. For example, a rotating flat disk could be used. Similarly a flat linearly oscillating plate could be used with the direction of surface oscillation set at any desired angle relative to the edge or alternatively made with an adjustable angle relative to the edge. Further the surface of a smooth rotating cylinder could be used to finish the edge. With a rotating cylinder, control of the angle between the plane of the edge facet and the plane to the rotating cylinder surface while possible become more difficult. Other applications of this new concept are apparent to those skilled in related areas.

Figure 8:
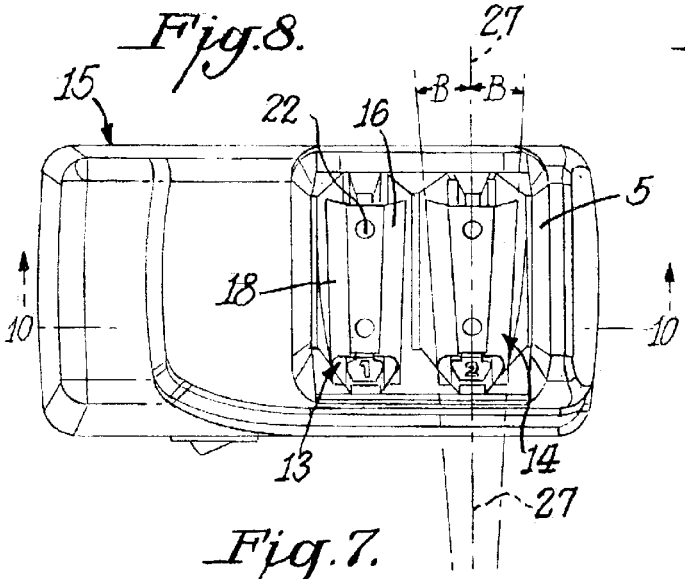
FIG. 8 is a top plan view of the apparatus shown in FIG. 7.

Referring to FIG. 2, it is evident that while the edge of knife 1 is shown to contact at point C against the truncated cone surface of disk 3, that point of contact can be readily moved by altering the angle B, FIG. 8 at which the blade is guided through Stage 2 of the apparatus 15 of FIGS. 7, 8, 9, and 10. The point C also can be raised to a higher or slightly lower position on disk 3 by altering the relative position of guides 5 and the cone surface 6. This versatility is useful when one wishes to optimize the nature of the edge produced by the finishing stage, Stage 2, as the edge is modified by successive passes through the left and right slots of that stage. It is preferable to alternate pulls through the left and right slots of Stage 2 shown in greater detail in FIG. 3. If adjustments are made to the guide or the taper of the disk surface in order to move contact point C toward the circumference of disk 3 the moving surface 6 of disk 3 will cross the edge at an angle closer to the perpendicular to the edge. In this situation the remaining burr structure will be pushed alternately from one side of the edge to the other or alternate pulls. As the contact point C moves toward a point directly above the center of the drive shaft 4 as seen in FIG. 2, the moving surface will be moving in a direction essentially parallel to the knife edge. The moving surface can move in a direction into or out of the edge.

The nature of the finishing along the edge and the coarseness of the final edge is influenced by the angle at which the surface crosses the edge. If for example, the surface passes the edge near the perimeter of the conical surface 6 and if the surface is moving away from the edge the surface will have a greater tendency to straighten the burr. However, if the surface moves into the edge or if one moves the contact point toward the vertical above shaft 4, there is a greater tendency to push the burr down against the facet which initially makes a thicker edge structure. With multiple passes of the knife edge in contact with the moving disk surface that thicker edge breaks off leaving larger irregularities along the edge. The larger irregularities may prove desirable for cutting very rough materials such as the crust of a bread. Likewise an edge finished closer to the edge of the disk perimeter will initially have finer irregularities along the edge—preferred for cutting finer foods such as tomatoes, lemons and limes.

In the convenient apparatus illustrated in FIGS. 7, 8, 9, 10 the disk 3 is made of a steel hardened approximately within the range Rockwell C 50–65. The surface roughness Ra is preferably less than 10 microns but could be higher to create edges of larger imperfections. Harder disks hold their shape better. The material selected for the disk surface has no tendency to abrade. However, because it is generally harder than the blade material, any surface roughness of the disk may create some burnishing and forming of the geometry's along the edge and on localized areas of the facets especially immediately adjacent to the edge.

Adding any particles known for their abrasive properties to the surface of the finishing disk (Stage 2) will tend to create burrs and may defeat functioning of the bending and fracturing process taking place with the relatively smooth non-abrasive disk surface. It is clear, however that coatings of micron or submicron size abrasive particles that do not substantially alter the surface geometry could enhance the edge hardness without adding adverse abrasive action.

The spring tension used to maintain the disk in contact with the blade edge is important. For optimum performance of this finishing concept the moving surface must be held against the edge with a force and precision adequate to minimize bouncing of the surface against the edge and sufficient to reform the burr and provide a mild fracturing pressure at the edge. The force must not, however be so large as to create excessive fracturing along the edge. With optimal restraining force in conjunction with appropriate surface speed it is possible to reform the burr and edge in a reasonably short time without an excessive number of passes of the blade. Clearly the finishing conditions must be optimized accordingly. Experience has shown that spring or restraining forces equal to or less than 0.2 lb. are optimal.

As shown in the cross-sectioned view of this illustrated sharpening/finishing apparatus 15 of FIG. 3, the sharpening disks 19 and the finishing disks 6 are mounted slidingly on shaft 4. These disks are supported by hubs 21 which are slotted to conform around pins 17 fastened to shaft 4. Rotation of shaft 4 rotates the hub 21 and disk 3 which are free to slide horizontally along shaft 4 when displaced by the blade 1 against the restraining force of spring 9. The clearance between the hub 21 and the shaft 4 is exceedingly small (less than 0.0015 inch) to insure minimum runout and vibration of the finishing surface 6. The blade 1 is held securely against the precision guides 18 and 5 by the holding spring structures 16, 16, FIG. 10 held in place by pins 22. Spring arms 23 part of holding spring structures 16, 16 press the blade against the guides. The spring guides 18 and 5 are labeled as 1, FIG. 7 for the first stage (sharpening) and 2 for the second stage (finishing). Motor 20, cooled by fan 28 drives shaft 4 which is positioned and held very precisely along its length by bearing assembly 24 which fits with close tolerances into supporting structure 25. In this manner the sharpening and finishing disks are held precisely in their rest position relative to the precision guides 18 and 5. The motor 20 for example rotates the disks of about 2" diameter at about 3600 revolutions per minute. A magnet 26 attracts metal fragments created by abrasion in Stage 1 and by the fracturing and forming process of Stage 2. The magnet can be removed periodically to remove metal fragments adhered to its surface.

The sharpening disks 19 of Stage 1 are preferably made of rigid steel formed with precision truncated cone shaped surfaces coated with abrasive particles of an optimum grit size for the intended use. The sharpening disks are supported on hubs 21 which are similar to those used to support the finishing disks of Stage 2. Pins 17 on shaft 14 drive these hubs and the attached disks at shaft speed. Spring 9 presses and holds the disks 19 slidingly against pins 17 until the disks are displaced laterally by the knife blade when inserted between the precision guides and the extension spring arms 23 of the holding spring 16, 16. The action of the precision sharpening disks 19, precision guides, 18 and precision hubs 21 is to establish the angle of the edge facets at the blade edge with an accuracy commonly to better than 0.5 degree. In this manner the angle of the abraded edge facets 7, FIG. 4 presented to the precision surfaces of the disks in the finishing stage is precisely known and precisely related to the angle of the moving surface of the finishing stage at the point of edge contact C, FIGS. 2 and 3. These precision relationships are critical to optimize the performance of the edge finishing process.

The grit size of the abrasive particles used in the abrasive Stage 1 influences the size and frequency of the burrs formed along the blade edge and subsequently affects the size and frequency of the imperfections left along the blade edge as that edge is modified in the finishing Stage 2. A typical size for diamond abrasive particles is 240/270 grit, but as described earlier that size can best be selected for optimal cutting by the edge in its intended application.

The benefits to be realized by the concepts disclosed here are edges of improved performance in cutting of a variety of fibrous foods such as meats and fibrous vegetables including carrots, corn, limes, lemons and pumpkins, also for cutting a variety of fibrous papers, cardboard and wood products. The versatility of the precision means described here suggests to the skilled a wide variety of physical arrangements to produce the improved edges described above.

What is claimed is:

1. A finishing apparatus for modifying the physical structure along the edge of a metal knife with the edge being formed at the junction of two edge facets preshaped with abrasives, comprising at least one precision angular knife guide having a guide surface to dispose one of the facets at a vertical angle A which is the angle of said guide surface to the plane of the one facet resulting from the preshaping, a driven moving member having an outer peripheral edge and a rigid side surface having an exposed non-abrasive generally smooth texture, said rigid side surface having a constantly moving contact surface which is to be contacted by the knife edge at the one facet with the one facet being disposed toward said contact surface, said contact surface and said guide surface forming a vertical angle $\alpha$ which is precisely established by said guide surface and is to be close to the angle A, and said rigid side surface being made of a hard material to be harder than the metal of the knife and to be without tendency to abrade.

2. A finishing apparatus according to claim 1 where said guide surface is planar.

3. A finishing apparatus according to claim 2 including a restraining structure that provides a restraining force to maintain one of said driven moving member and said knife guide in a fixed position relative to the other of said driven moving member and said knife guide unless said moving member is contacted by the knife edge to permit lateral displacement of said one of said driven moving member and said knife guide against said restraining force when so contacted and further displaced.

4. A finishing apparatus according to claim 3 where said restraining force is equal to or less than two-tenths (0.2) pound when said driven moving member and said knife guide are held in said fixed position.

5. A finishing apparatus according to claim 3 where said restraining structure is a spring.

6. A finishing apparatus according to claim 3 where said one of said driven moving member and said knife guide is said driven moving member.

7. A finishing apparatus according to claim 3 where said one of said driven moving member and said knife guide is said knife guide.

8. A finishing apparatus according to claim 3 where said contact surface has a surface roughness (Ra) of less than 40 microns.

9. A finishing apparatus according to claim 1 including a restraining structure that provides a restraining force to maintain one of said driven moving member and said knife guide in a fixed position relative to the other of said driven moving member and said knife guide unless said moving member is contacted by the knife edge to permit lateral displacement of said one of said driven moving member and said knife guide against said restraining force when so contacted and further displaced.

10. A finishing apparatus according to claim 1 where the difference between the angle A and the angle $\alpha$ is to be within five (5) degrees.

11. A finishing apparatus according to claim 1 where said rigid surface of said driven moving member has the shape of a truncated cone.

12. A finishing apparatus according to claim 1 where said rigid surface of said driven moving member has a nominally spherical surface at the location of contact with the knife edge.

13. A finishing apparatus according to claim 1 where said rigid surface of said driven moving member is a planer surface.

14. A finishing apparatus according to claim 1 where said rigid surface of said driven moving member is a cylindrical surface.

15. A finishing apparatus according to claim 1 including a sharpening section with at least one precision angular knife guide to guide and to locate the knife edge against a powered precision moving abrasive surface in said sharpening section and to position one or more abraded facets along the edge at an angle within five (5) degrees of an angle maintained between the abraded facets and said contact surface of the driven moving surface of said finishing apparatus.

16. The finishing apparatus according to claim 1 including a set of side by side of said driven moving members, one of said precision knife guides being adjacent each of said moving members to position a facet of the blade at a predetermined angle relative to the plane of said rigid surface of said driven moving member, including an inverted U shaped spring member having cantilevered resilient arms and an intermediate connecting portion, said connecting portion being mounted over said set of driven moving members, and each of said arms of said spring member extending downwardly generally along a portion of a respective one of said precision knife guides.

17. A finishing apparatus according to claim 1 including a set of side by side of said driven moving members, one of said precision knife guides being adjacent each of said moving members to position a facet of the blade at a predetermined angle relative to the plane of said rigid surface of driven moving member, said knife guide comprising magnetic structure having a magnetic guide surface having two opposite polarity magnetic poles comprising a north and south pole oriented such that a magnetic field is created along said guide surface of said knife guide to hold the knife against said guide surface and move the knife therealong into engagement with said moving member.

18. A finishing apparatus according to claim 1 in combination with a sharpener having a first stage sharpening section and a second stage finishing section, and said finishing apparatus being incorporated in said finishing section.

19. A finishing apparatus for modifying the physical structure along the edge of a metal knife with the edge being formed at the junction of two edge facets preshaped with abrasives, comprising at least one precision angular knife guide having a guide surface to dispose the plane of one of the facets at a vertical angle to said guide surface, a driven moving member having an outer peripheral edge and a rigid side surface having an exposed non-abrasive generally smooth texture with a surface roughness (Ra) of less than 40 microns, said rigid side surface having a constantly moving contact surface for being contacted by the knife edge at the one facet when the one facet is disposed toward said contact surface, said contact surface and said guide surface forming a vertical angle which is precisely controlled by said guide surface, a restraining structure providing a restraining force that maintains one of said knife guide and said moving member in a fixed position relative to the other of said knife guide and said driven member unless said driven member is contacted by the knife edge and that permits lateral displacement of said one of said knife guide and said driven member against said restraining force when contacted and further displaced by the knife edge or its facet, said restraining force being equal to or less than two-tenths (0.2) pound when said driven moving member and said knife guide are held in said fixed position, and said rigid side surface being made of a hard material to be harder than the metal of the knife and to be without tendency to abrade.

20. A finishing apparatus according to claim 19 where said guide surface is planar.

21. A finishing apparatus according to claim 19 where said restraining structure is a spring.

22. A finishing apparatus according to claim 20 where said one of said driven member and said knife guide is said knife guide.

23. A finishing apparatus according to claim 19 where said one of said driven moving member and said knife guide is said driven moving member.

24. A finishing apparatus according to claim 19 where said rigid surface of said driven moving member has the shape of a truncated cone.

25. A finishing apparatus according to claim 19 where said rigid surface of said driven moving member has a nominally spherical surface at the location of contact with the knife edge.

26. A finishing apparatus according to claim 19 where said rigid surface of said driven moving member is a planer surface.

27. A finishing apparatus according to claim 18 where said rigid surface of said driven moving member is a cylindrical surface.

28. A finishing apparatus according to claim 19 including a sharpening section with at least one precision angular knife guide to guide and to locate the knife edge against a powered precision moving abrasive surface in said sharpening section and to position one or more abraded facets along the edge at an angle within five (5) degrees of an angle maintained between the abraded facets and said contact surface of the driven moving surface of said finishing apparatus.

29. The finishing apparatus according to claim 19 including a set of side by side of said driven moving members, one said precision knife guides being adjacent each of said moving members to position a facet of the blade at a predetermined angle relative to the plane of said rigid surface of said driven moving member, including an inverted U shaped spring member having cantilevered resilient arms and an intermediate connecting portion, said connecting portion being mounted over said set of driven moving members, and each of said arms of said spring member extending downwardly generally along a portion of a respective one of said precision knife guides.

30. A finishing apparatus according to claim 19 including a set of side by side of said driven moving members, one said precision knife guides being adjacent each of said moving members to position a facet of the blade at a predetermined angle relative to the plane of said rigid surface of driven moving member, said guide comprising magnetic structure having a magnetic guide surface having two opposite polarity magnetic poles comprising a north and south pole, oriented such that a magnetic field is created along said guide surface of said knife guide to hold the knife against said guide surface and move the knife therealong into engagement with said moving member.

31. A method of finishing a metal knife blade to modify the physical structure along the edge of the blade wherein the edge is formed the junction of two edge facets, comprising abrasively sharpening the edge, placing the sharpened knife blade in a finishing apparatus having an angular knife guide with a guide surface and having a moving member with a rigid side surface having an exposed non-abrasive generally smooth texture, disposing the knife blade against the guide surface with the plane of one facet at a vertical angle A with respect to the guide surface and with the edge against the rigid side surface, a vertical angle D being formed between the plane of the one facet and the rigid side surface, a vertical angle $\alpha$ being formed by the guide surface and the rigid side surface and being precisely established by maintaining the knife blade against the guide surface, the angle $\alpha$ comprising the angle A plus the angle D, the angle $\alpha$ being close to the angle A, the rigid side surface being harder than the metal of the knife blade, and moving the rigid side surface while the edge is disposed against the rigid side surface to finish the knife blade edge.

32. The method of claim 31 wherein the angle $\alpha$ is within five (5) degrees of the Angle A.

33. The method of claim 31 wherein the angle $\alpha$ is plus or minus three (3) degrees of the angle A.

34. The method of claim 31 including applying a restraining force against one of the knife guide and the moving member to maintain the knife guide and the moving member in a fixed position relative to each other unless the knife edge contacts the moving member to cause lateral displacement of the knife guide or moving member.

35. The method of claim 34 where the restraining force is equal to or less than two-tenths (0.2) pound.

* * * * *

UNITED STATES PATENT AND TRADEMARK OFFICE
Certificate

Patent No. 6,863,600 B2 Patented: March 8, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Daniel D. Friel, Sr., Greenvilee, DE (US); and Robert P. Bigliano, Wilmington, DE (US).

Signed and Sealed this Third Day of February 2009.

Joseph J. Hail, III
*Supervisory Patent Examiner*
Art Unit 3723